United States Patent [19]

Gregory

[11] Patent Number: 4,700,859

[45] Date of Patent: Oct. 20, 1987

[54] TAMPER INDICATING CLOSURE

[75] Inventor: James L. Gregory, Toledo, Ohio

[73] Assignee: Owens-Illinois Closure Inc., Toledo, Ohio

[21] Appl. No.: 895,070

[22] Filed: Aug. 11, 1986

[51] Int. Cl.[4] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 4,493,427 | 1/1985 | Wolkonsky | 215/252 X |
| 4,511,053 | 4/1985 | Brandes et al. | 215/252 |
| 4,573,601 | 3/1986 | Berglund | 215/252 |
| 4,576,298 | 3/1986 | Boik | 215/252 |
| 4,629,082 | 12/1986 | Iniesta | 215/252 |

FOREIGN PATENT DOCUMENTS

| | | | |
|---|---|---|---|
| 2290364 | 6/1976 | France | 215/252 |

*Primary Examiner*—Donald F. Norton

*Attorney, Agent, or Firm*—H. G. Bruss

[57] ABSTRACT

A tamper indicating closure for a container comprising a threaded cap to which is attached an indicator ring. The indicator ring has a radially inward lower flange that slips into locking engagement with a flange on the neck of the container as the closure is applied to the container. As the closure is removed from the container, the indicator ring is severed along weakened portions so that the lower portion of the indicator ring drops clear of the closure thus providing an indication the closure has been rotated in a direction for its removal from the container.

6 Claims, 4 Drawing Figures

TAMPER INDICATING CLOSURE

BACKGROUND OF THE INVENTION

With the advent of more frequent tampering of products packages in containers, it has become quite important to provide the public with some positive indication whether a purchased product has been tampered with subsequent to leaving the manufacturer's plant.

Products packaged in containers such as bottles have become quite vulnerable to tampering, consequently many tamper indicating systems have been devised. One such tamper indicating system for threaded bottles is disclosed in U.S. Pat. No. 4,511,053 which issued Apr. 16, 1985. This patent shows a metal closure that has a radially inward lower skirt portion that clamps against the upper portion of a plastic tamper indicating ring. The tamper indicating ring has a series of grooves around the lower skirt to facilitate assembly of the tamper indicating ring over the retaining flange that is located beneath the threaded portion of the container neck. Thus, special provisions have to be made for easing the lower portion of the tamper indicating ring over the container finish. Also, the metal cap skirt has to be specially designed to accommodate the upper portion of the tamper indicating ring. As a closure removal torque is applied to the closure, the upward force causes the lower portion of the tamper indicating ring to engage the under side of the flange on the container thus causing the ring to break along a weakened circumferential line.

Another example of a tamper ring-closure combination is shown and described in U.S. Pat. No. 4,493,427 which issued Jan. 15, 1985. The tamper indicating portion of the closure assembly is essentially "Z" shaped with a lower tongue resting under a flange beneath the container finish when in the installed position. The upper portion of the tamper indicating ring has a radially outwardly protruding ring that coacts with a portion of the closure inside. Retrograde rotation of the closure produces tensile and shear forces within the tamper indication ring thus causing it to break along a weakened section.

U.S. Pat. No. 4,503,986 which issued Mar. 12, 1985, describes a closure and accompanying tamper indicating ring. A series of vertically aligned bridges connect the lower and upper portions of the tamper indicating ring together. Subsequent removal of the closure from the container causes the upright bridges to shear thus severing the tamper indicating ring.

SUMMARY OF THE INVENTION

This invention relates to tamper indicating closures for containers such as bottles. More particularly, the invention relates to a closure and tamper indicating combination that can be applied to a container as a single unit, yet upon removal of the closure from the container, the tamper indicating ring separates thus providing a visual indication that the closure has been removed from the container. The present invention permits the use of a tamper indicating ring with a stock closure, in other words, no special feature need be designed into the closure to accommodate the tamper indicating ring since the closure and ring are thermally united. A provision is made to take the downward force upon application of the closure-ring combination without breaking the frangible portions of the tamper indicating ring.

An embodiment of the present invention utilizes flexible inclined connecting posts between the upper and lower portions of the tamper indicating ring that is attached to the closure flange.

One of the objectives of the present invention is to reduce the cost of manufacturing closure and tamper indicating ring combinations.

Another object of this invention is to provide an easily frangible tamper indicating ring that can withstand the rigors of machine installation of a closure to a container.

The closure and tamper indicating ring can be fabricated of any single plastic material or combination of materials such as for example polypropylene, polyethylene, polyvinylchloride, polyethylene terphthalate, butadine styrene, acrylics such as acrylonitrile polytetraflouroethylene, and polycarbonates. The main factor in material selection is that the closure and tamper indicating ring can be joined together in an easy manner by techniques such as ultrasonic welding, or the utilization of solvents.

DETAILED DESCRIPTION OF THE INVENTION

Figure 1:
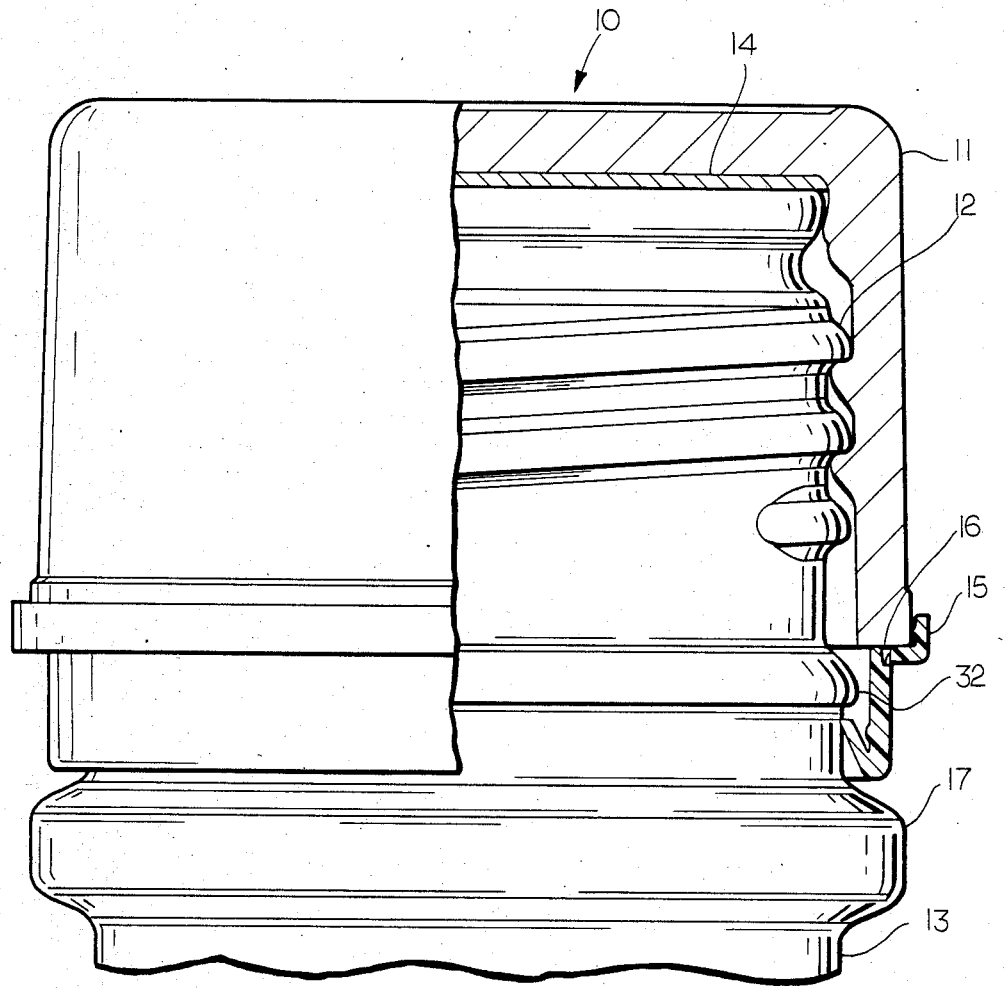
FIG. 1 is a side view, part in section of a closure-tamper indicating ring combination installed on the finish of a container.

The overall closure-tamper indicating ring combination is generally represented by the numeral 10 as shown in FIG. 1. The closure 11 is depicted in the sealed position against the threaded finish 12 of container 13. A fluid tight seal is effected by providing a resilient closure liner 14 between the inner top surface of closure 11 and the top lip of finish 12.

The closure 11 is of standard configuration and can be used without being coupled to a tamper indicating ring. One of the important aspects of the present invention is the standard closure 11 can be utilized with a tamper indicating ring without any modifications or adaptions being necessary to the closure.

Figure 2:
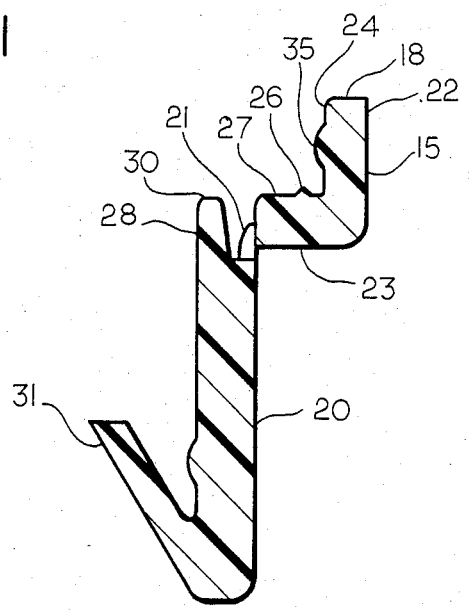
FIG. 2 is an enlarged cross sectional view through the tamper indicating ring only.

FIG. 1 also shows a tamper indicating ring 15 interdisposed between the lip 16 of closure 11 and collar 17 of the container 13. Tamper indicating ring 15 can be seen best in FIG. 2. Ring 15 is divided into two sections; upper ring section 18 and lower ring section 20. The ring sections 18 and 20 are united by a frangible bridge 21. While it is conceivable one such frangible bridge 21 would function to hold ring sections 18 and 20 together, it is more practical to utilize three or four circumferentally spaced bridges 21 in order to maintain continuity between ring sections 18 and 20 during the manufacturing steps up to and including installation on the container.

Upper ring section 15 comprises an axially aligned cylindrical section 22 that is attached to collar 23 which is essentially perpendicular to the container and closure axis as well as cylindrical section 22. The inner wall 24 of cylindrical section 22 contains spherical projections 35 that aid in holding the tamper indicating ring assembly in position with the closure exterior wall adjacent lip 16. The collar portion 23 of upper ring section 18 contains a weld bead 26 on surface 27 that is essentially continuous circumferentially around collar 23.

The lower ring section 20 has an upstanding cylindrical ring 28. The terminal end 30 of cylindrical ring 28 is essentially planar with respect to surface 27 of collar 23.

As can be seen in FIG. 1, the terminal end 30 of cylindrical ring 28 abuts against the surface of lip 16. This interaction between lip 16 and terminal end 30 permits a transfer of load to both upper and lower ring sections 20 and 22 without undue flexing that would have a tendancy to fracture the frangible bridges 21.

The body portion of lower ring section 20 has integrally coupled thereto a flexible frusto-conical lip 31. The wall thickness of frusto-conical lip 31 is thinner than the wall thickness of lower ring section 20 consequently it is more flexible thus enabling lip 31 to expand radially as it slips over the retaining ring 32 (FIG. 1) during installation of the closure and tamper indicating ring assembly on the container finish.

As previously pointed out, the closure utilized in the present invention is a stock closure thus it has no special adaptions for accommodation of a tamper indicating ring as is evidenced by many of the prior art patents. The tamper indicating ring 15 fits in telescopic arrangement with the lower lip 16 of closure 11. The configuration of weld bead 26 acts as an energy guide thus causing a concentration of heat in the general area of bead 26 if ultrasonic energy is used to bond the parts together. The ultrasonic energy utilized to effect a heat seal between closure 11 and ring 15 is conventional and can be applied through an acoustic impedance transformer at energy levels up to 100 kilohertz. In the alternate, if a solvent system is employed to bond closure 11 to ring 15, the configuration of bead 26 lends itself to solvent softening thus providing material for uniting ring 15 to closure 11.

Stock closures can be manufactured having a given millimeter size. If a particular closure application requires a tamper indicating protection system. closures can be drawn from inventory and can be assembled with tamper indicating rings as described in the present invention. Not only can the color of the closure be varied, but also, the color of the tamper indicating ring can vary from that of the closure.

After the closure 11 and tamper indicating ring 15 have been assembled by ultrasonic welding, solvent, or other coupling techniques, the closure is installed over the finish of a container such as a bottle manufactured of any well known material such as glass, plastic or metal. As the closure moves downward over the threads of the finish through the application of an installation torque, the tamper indicating ring is likewise forced over the finish. The installation force is applied to both upper and lower ring sections thus preserving the integrity of the frangible bridges 21. The frusto-conical lip 31 bends over the finish contour and finally comes to rest beneath the container retaining ring 32. At this point of installation, the closure is completly installed and a seal between the closure and the container is effected by means of closure liner 14.

Because of the extremely frangible nature of bridges 21 positioned between upper and lower ring sections 18 and 20, any appreciable removal torque to the closure will cause the closure to move axially with respect to the finish of the container thus causing the tip of frusto-conical lip 31 to wedge under the lower edge of the container retaining ring 32. Since upward movement of the lower ring section 20 is restricted, the removal torque that is applied to the closure 11 will rupture the frangible bridges 21 thus causing the ring section 20 to become disengaged from the remainder of the closure-ring combination.

Figure 3:
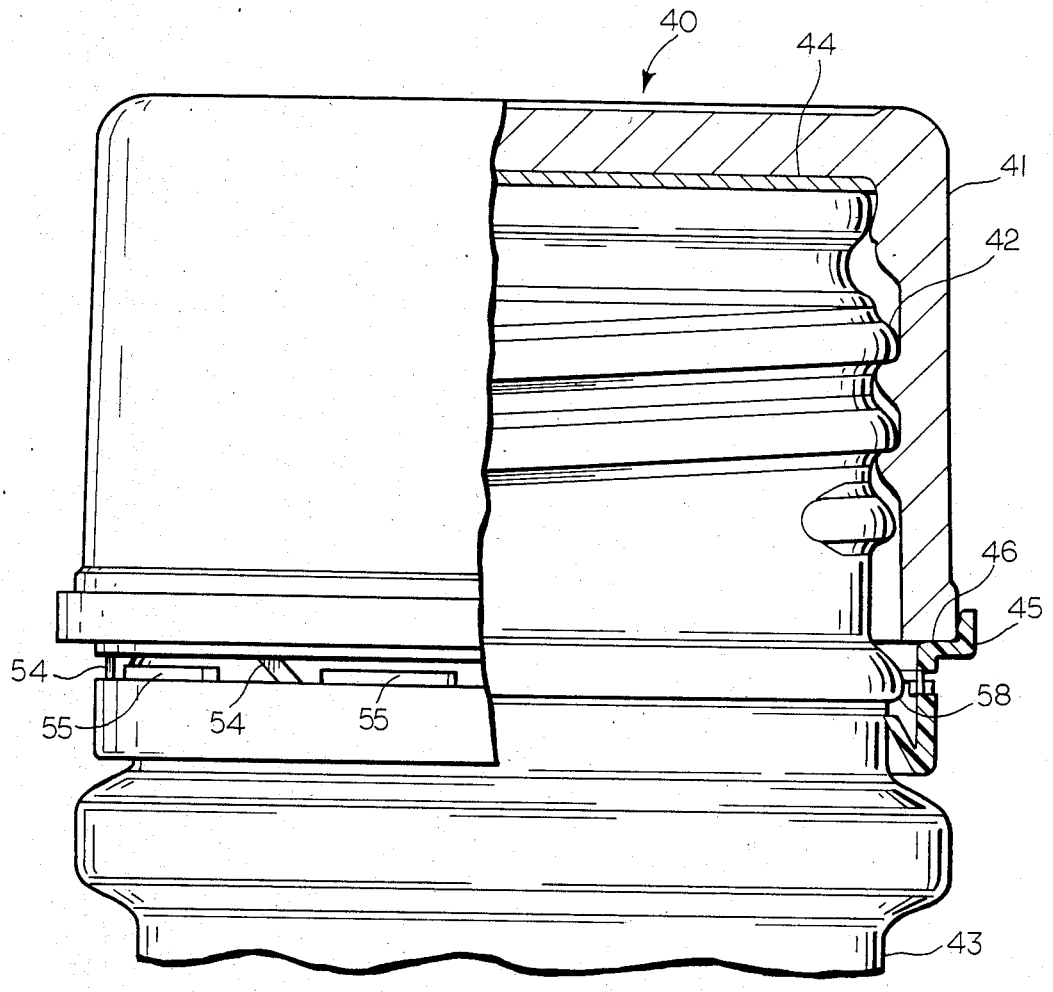
FIG. 3 is a side view, part in section, of an embodiment of a tamper indicating ring installed on a container finish along with a closure.
Figure 4:
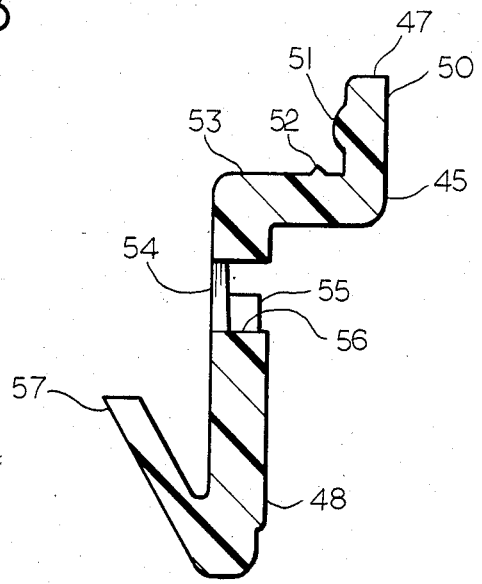
FIG. 4 is an enlarged cross sectional view through the tamper indicating ring embodiment.

FIG. 3 shows an embodiment of the present invention. The overall assembly is identified by numeral 40. A gasket or liner 44 is positioned between closure 41 and the top of the threaded finish 42 of container 43. A tamper indicating ring 45 is shown in abutting relationship with closure 41 and installed on container 43. The tamper indicating ring 45 is comprised of upper and lower ring sections 47 and 48 as shown in FIG. 4. The upper ring section 47 has a cylindrical section 50 that coacts in telescopic arrangement with the lip 46 of closure 41. Spherical projections 51 provide for a snug fit between the closure 41 and upper ring section 47. An energy concentration weld bead 52, or solvent aid, is positioned on surface 53 of ring section 47.

The upper ring section 47 is connected to the lower ring section 48 by a plurality of frangible bridges 54. While FIG. 4 shows the overall height of the bridges 54, FIG. 3 shows that the bridges 54 are inclined to the overall vertical axis of the closure-container combination. The angle of inclination of bridges 54 can vary between 30 to 75 degrees with respect to a plane perpendicular to the longitudinal axis of the closure-container combination. The actual angularity of bridges 54 depends upon the thermoplastic material selected and its frangibility. The direction of slope of the bridges 54 is important. Retrograde torque, when applied to the closure, should cause the closure 41 and attached upper ring section 47 to move away from lower ring section 48 simply because such retrograde torque causes bridges 54 to move toward a more axially aligned position. Conversely, ordinary closure tightening torque causes bridges 54 to draw the upper and lower ring sections 47 and 48 toward each other. To prevent the bridges 54 from fracturing when a tightening torque is applied to closure 41, blocks 55 are spaced circumferentially around and attached to the upper edge 56 of lower ring section 48. The blocks 55 are arcuate in configuration the same as the general configuration of ring 45. The blocks 55 would function equally well if they were attached to the lower edge of cylindrical section 50. A small space in the order of 0.025 inch is provided between blocks 55 and adjacent upper ring section 47. As previously pointed out, a clockwise or closure application torque causes upper ring section 47 to move toward lower ring section 48. The movement together of ring sections 47 and 48 is stopped by blocks 55 thus preserving the integrity of frangible bridges 54.

During the assembly of the closure 41 to the tamper indicating ring 45, an energy concentrator or weld bead 52 is fused with the lip 46 of closure 41. Thus during counterclockwise torguing of the closure, the entire tamper indicating ring 45 moves counterclockwise with closure 41. The surface 53 of upper ring section 47 permits a compression force to be delivered to the blocks 55 of lower ring section 48. The compressive force applied to lower ring section 48 causes frusto-conical lip 57 to be forced over the threaded finish and particularly over retaining ring 58.

Retrograde torque, when applied to closure 41 causes bridges 54 to undergo tensile and shear forces which leads to ultimate fracture of the frangible bridges 54 since lower ring section 48 cannot move with the remainder of the closure assembly because lip 57 is firmly locked beneath retaining ring 58.

It is to be understood the form of the present invention above shown and described is to be taken as a preferred example of the invention and that various small changes in the geometry and arrangement of the parts may be resorted to without departing from the spirit of the invention or scope of the appended claims.

What is claimed is:

1. A tamper indicating package comprising a container with a threaded neck finish and a retaining ring interdisposed between said threaded portion and the body of the container, an internally threaded skirted closure compatable with the threads on said finish, a tamper indicating ring in telescopic arrangement with and fastened to the extremity of said closure skirt so that there is circumferential contact between said closure extremity and said tamper indicating ring, said tamper indicating ring comprised of first and second sections with frangible means interdisposed between said sections and wherein a portion of each of said sections abuts against said extremity of said closure skirt so that an axial force can be transmitted to said ring to cause a frusto-conical portion thereof to lodge beneath said container retaining ring, and when the closure is rotated, in a retrograde manner, the frangible means are severed.

2. A closure and tamper indicating ring combination including an internally threaded skirt portion on said closure, said ring attached to and in telescopic arrangement with the end of said skirt, said ring comprising first and second sections with at least one frangible member attached to and interdisposed between said sections, said first section comprising a cylindrical portion telescoped over a portion of the lower exterior of said skirt, a radially inward flange attached to the cylindrical portion of said first section, said second section being essentially cylindrical in configuration with an abutment ring on one end adjacent said frangible member and a frusto-conical section attached to the end of said second section opposite to said abutment ring, said radially inward portion of said first section and said abutment ring of said second section both in abutting relation with said end of said closure skirt.

3. A closure and tamper indicating ring combination including an internally threaded skirt portion on said closure, said ring attached to and in telescopic arrangement with the end of said skirt, said ring comprising first and second sections with frangible members attached to and interdisposed between said sections, said first section attached to the skirt of said closure so that a cylindrical portion thereof telescopes over a portion of the lower exterior skirt wall of said closure, a radially inward flange attached to said cylindrical portion, said second section being remote from said skirt, said frangible members comprised of circumferentially spaced apart elongate bridge members that are connected between the innermost edge of said radially inward flange and one end of said second section and that slope with respect to the principal axis of said closure, blocking means positioned between said sections and attached to the edge of at least one of said sections thus permitting a closure installation force to be transmitted through said blocking means from said first section to said second section without rupturing said frangible members, and means connected to said second section to prevent its removal from a container when the closure and said first section are removed therefrom.

4. A closure and tamper indicating ring combination as set forth in claim 3 wherein the blocking means are attached to said second section and are intercalated with respect to said frangible members.

5. A closure and tamper indicating ring combination as set forth in claim 3 wherein a frusto-conical section is attached to the end of the second section opposite the blocking means.

6. A closure and tamper indicating ring combination including an internally threaded skirt portion on said closure, said ring comprising first and second sections, said first section having a cylindrical portion adapted to telescope over a portion of the lower exterior wall of said closure, a radially inward flange attached to said cylindrical portion, said inward flange attached to the lower edge of said closure skirt by ultrasonic welding, said second section being essentially cylindrical in configuration with an abutment ring on the end adjacent the closure skirt and a frusto-conical section attached to the end of the second section opposite the abutment ring, said abutment ring of said second section and the radially inward flange of said first section both abut against the lower edge of said closure skirt thus permitting a closure installation force to be transmitted to both of said sections, and a plurality of circumferentially spaced frangible bridges integrally formed between the innermost edge of said radially inward flange of said first section and said abutment ring of said second section.

* * * * *